United States Patent [19]

Claunch et al.

[11] 4,098,557

[45] Jul. 4, 1978

[54] ACID PUMP

[75] Inventors: C. Kenneth Claunch; Robert Bailey Way, both of Erie, Pa.

[73] Assignee: Finish Engineering Company, Erie, Pa.

[21] Appl. No.: 710,261

[22] Filed: Jul. 30, 1976

[51] Int. Cl.[2] ..... F01D 11/00

[52] U.S. Cl. ..... 415/111; 277/212 F; 415/143; 417/424

[58] Field of Search ..... 415/110, 111, 143, 73, 415/62, 170 A; 417/424; 277/265 R, 212 R, 212 C, DIG. 6

[56] References Cited

U.S. PATENT DOCUMENTS

| | | | |
|---|---|---|---|
| 1,423,496 | 7/1922 | Haney | 415/110 |
| 1,796,017 | 3/1931 | Grant | 277/212 F |
| 2,116,397 | 5/1938 | Lanham | 415/111 |
| 2,625,414 | 1/1953 | Kranz | 277/212 F |
| 2,865,296 | 12/1958 | Bungartz | 415/143 |
| 2,881,707 | 4/1959 | Thompson | 415/143 |
| 2,930,325 | 3/1960 | Beard et al. | 417/424 |
| 3,093,156 | 6/1963 | Nielsen | 417/424 |
| 3,108,018 | 10/1963 | Lewis et al. | 277/MD DIG. 6 |
| 3,223,676 | 12/1965 | Rucker | 277/MD DIG. 6 |
| 3,408,942 | 11/1968 | Davenport et al. | 417/424 |

FOREIGN PATENT DOCUMENTS

| | | | |
|---|---|---|---|
| 1,928,245 | 4/1970 | Fed. Rep. of Germany | 277/205 |
| 928,749 | 6/1963 | United Kingdom | 277/MD DIG. 6 |

*Primary Examiner*—C. J. Husar
*Attorney, Agent, or Firm*—Charles L. Lovercheck

[57] ABSTRACT

A pump for liquids made up of a tube having an inlet and an oulet with a shaft extending through it. The lower end of the shaft has an impeller and a motor drives the upper end of the shaft. A seal is supported on the shaft between the outlet and the motor preventing liquid from moving up past the seal. The seal fits tightly in the tube and has an inwardly-extending flange with an axially-extending flange with a central bore which receives the shaft. The bore in the axially-extending flange is smaller than the shaft so that the shaft expands the axially-extending flange thereby providing a liquid-tight seal around the shaft.

4 Claims, 5 Drawing Figures

FIG. 1.
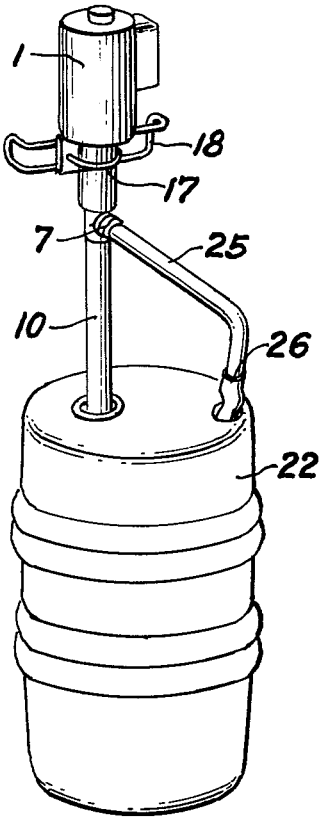
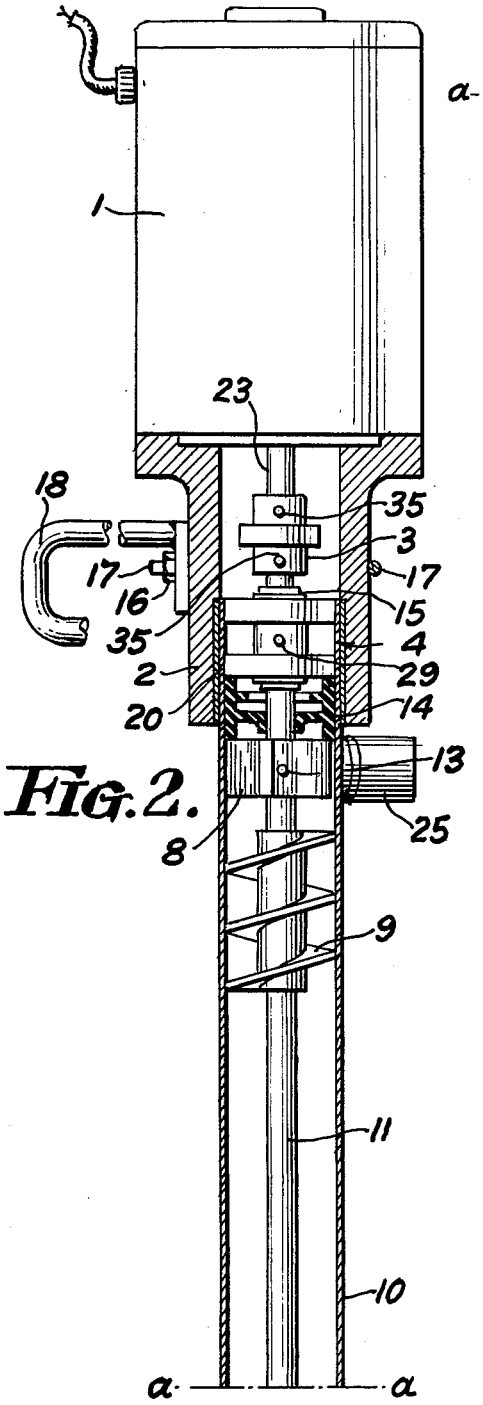
FIG. 2.
FIG. 3.
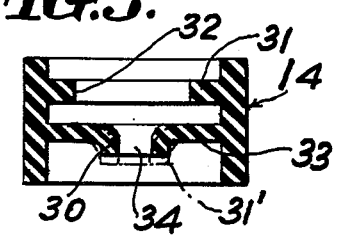
FIG. 4.
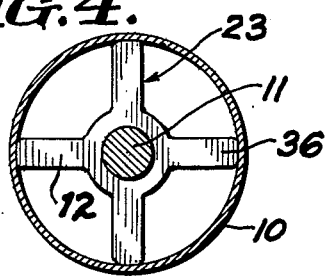
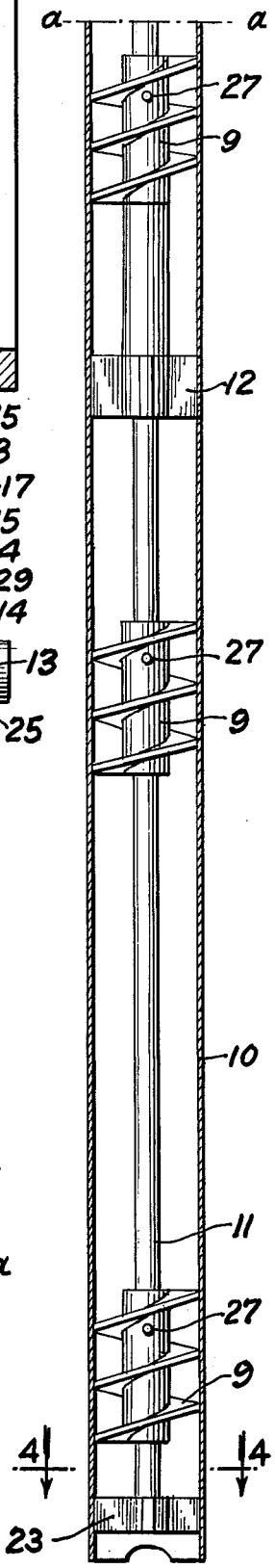
FIG. 5

ACID PUMP

OBJECTS OF THE INVENTION

It is an object of the invention to provide an improved pump.

Another object of the invention is to provide a liquid pump in combination with a seal.

Another object of the invention is to provide an improved pump and seal combination.

With the above and other objects in view, the present invention consists of the combination and arrangement of parts hereinafter more fully descirbed, illustrated in the accompanying drawing and more particularly pointed out in the appended claims, it being understood that changes may be made in the form, size, proportions and minor details of construction without departing from the spirit or sacrificing any of the advantages of the invention.

GENERAL DESCRIPTION OF DRAWINGS

FIG. 1 is an isometric view of the pump installed in a container.

FIG. 2 is an enlarged cross-sectional view of the pump according to the invention.

FIG. 3 is an enlarged cross-sectional view of the seal used with the pump.

FIG. 4 is a cross-sectional view taken on line 4-4 of Line 5 of one of the bearings.

FIG. 5 is a partial view of one end of the pump tube.

DETAILED DESCRIPTION OF DRAWINGS

Now, with more particular reference to the drawing, the pump shown has a tubular body 10 that fits down into a container indicated at 22 which may be a barrel containing acid or other corrosive liquid. The pump is provided with a motor at its upper end. The motor 1 has a shaft 23 which is connected through a flexible coupling 3 to the main shaft 11. Main shaft 11 is supported in the tube 10 and piloted in the tube by the center bearing 12, bottom bearing 23 and top bearing 4. The pump shown has compressors 9 which are shown as being three in number; however, any suitable number of compressors could be used and the compressors could take different configurations of spiral fins than those indicated in the drawing.

The tubular member 10 could be of any suitable length to extend into any suitable container.

An impeller 8 is pinned to the shaft by a roll pin 13 adjacent the outlet tube 25 and the outlet tube extends from the tubular member 10 to a point of discharge indicated at 26.

The seal 4 may be pressed into the tube 10 and will rotatably receive the shaft 11 in the central bore. Outwardly-extending spider legs 36 on bearing 12 will allow liquid to flow between them.

The impeller 8 may have suitably shaped impeller legs to force the liquid out of the outlet tube 25.

The compressors 9 have a central bored boss pinned to the shaft 11 by pins 27. The compressors will have a spiral fin 28 of a type familiar to those skilled in the art.

The upper seal 4 is pinned to the shaft 11 by means of a pin 29 and it rotates in the sleeve 20 which is fixed to the adapter 2.

The upper seal 4 is supported against the retaining ring 15, just below the flexible coupling 3. The flexible coupling is pinned to the shaft by means of roll pins 35. The handle 18 is attached to the adapter 2 by means of the hanger bolt 17 which is held in place by means of the hex nut 16.

The seal 14 at the upper end of the tube 10 has a smooth outside cylindrical surface that fits tightly into the upper end of the tube 10. An inwardly-directed flange 31 is integrally fixed to the inner periphery of the cylindrical body of the seal 14 and terminates in a relatively large central bore 32. A second inwardly-directed, radially-extending flange 33 terminates in a bore 34 which is slightly lesser in diameter than the outer diameter of the shaft 11. The radially, inwardly-directed flange 33 has an axially-extending flange 30 integrally attached thereto and the bore 34 extends through the radially-extending flange 33 and continues through the flange 30. Thus, when the shaft 11 is installed from the upstream end of the tube 10 and forced through the end of the bore 34, the flange 33 is distorted downstream to the position shown in dotted lines in FIG. 3 at 31'. The axially-extending flange 30 will be concentric to the shaft and will be urged into sealing engagement with the shaft. A drain tube 26 drains out any liquid that passes seal 14.

The seal 14 is made of a teflon material filled with 12–15% carbon which is resilient and will be constantly urged by its resilient properties into rigid sealing engagement with the outer periphery of the shaft. Tests showed that 25% carbon was undesirable and that 12% held up twice as well as 15%.

In practice, the shaft 11 may be a rod one-fourth inches in diameter and the bore 34 may be between 0.295 and 0.3000 inches. The axially-extending flange 20 may be 0.040 plus or minus 0.002 inches.

The foregoing specification sets forth the invention in its preferred practical forms but the structure shown is capable of modification within a range of equivalents without departing from the invention which is to be understood is broadly novel as is commensurate with the appended claims.

The embodiments of the invention in which an exclusive property or prvilege is claimed are defined as follows:

1. A pump for corrosive materials comprising, a tubular body 10 having an inlet at its lower end and an outlet (25) at its upper end and a shaft 11 in said tubular body, an impeller (8) on the shaft (11) adjacent said outlet (25), first bearing means (4), said first bearing means (4) having a body on said shaft 11 adjacent said outlet (25) and supporting said shaft against radial motion in said body, second bearing means (23) on said shaft (11) at the lower end thereof, motor means 1 connected to said shaft (11), a seal (14) between said outlet (25) and said first bearing means (4), said seal (14) comprising a cylindrical body pressed into said tubular body (10) adjacent said outlet (25), said seal (14) having a cylindrical first bore therethrough and a first radially-directed flange (31) in said first bore and a second radially-directed flange (33), said first radially-directed flange (31) terminating in spaced relation to the outer periphery of said shaft 11 and integrally attached to the inner periphery of said cylindrical body of said seal (14), said first radially-directed flange (31) having a relatively large bore (32) therethrough, said first radially-directed flange (31) providing reinforcement for said cylindrical body of said seal (14), said second radially-directed flange (33) being spaced axially from said first radially-directed flange (31), said second radially-directed flange (33) having an axially-extending flange (30) integrally attached to said second radially-directed flange (33) adjacent the center thereof and a second bore 34 extending through said axially-extending flange 30 and through said second radially-extending flange (33), said second bore (34) being of a lesser diameter than the diameter of said shaft (11), whereby when said shaft 11 is pushed through said second bore, it expands said axially-extending flange (30), thereby causing said axially-extending flange 30 to resiliently engage said shaft (11) in sealing engagement with the outer periphery of said shaft (11) preventing fluid from flowing from said tubular body (10) to said first bearing means (4).

2. The pump reicted in claim 1 wherein said seal is made of material containing teflon.

3. The pump recited in claim 1 wherein said bore is approximately 0.100 inches smaller than the outside diameter of said shaft.

4. The pump recited in claim 2 wherein said seal member is made of a material containing Teflon and 10 percentage of carbon by volume.

* * * * *